US010821313B2

(12) United States Patent
Tuller

(10) Patent No.: US 10,821,313 B2
(45) Date of Patent: Nov. 3, 2020

(54) PORTABLE BARRE EXERCISE DEVICE

(71) Applicant: Jeff Tuller, San Marcos, CA (US)

(72) Inventor: Jeff Tuller, San Marcos, CA (US)

( * ) Notice: Subject to any disclaimer, the term of this patent is extended or adjusted under 35 U.S.C. 154(b) by 34 days.

(21) Appl. No.: 16/357,060

(22) Filed: Mar. 18, 2019

(65) Prior Publication Data

US 2020/0114190 A1 Apr. 16, 2020

Related U.S. Application Data

(60) Provisional application No. 62/744,539, filed on Oct. 11, 2018.

(51) Int. Cl.

| | |
|---|---|
| ***A63B 1/00*** | (2006.01) |
| ***A63B 17/00*** | (2006.01) |
| *A63B 71/02* | (2006.01) |
| *A63B 21/00* | (2006.01) |

(52) U.S. Cl.

CPC ..... *A63B 1/00* (2013.01); *A63B 17/00* (2013.01); *A63B 21/00047* (2013.01); *A63B 21/4027* (2015.10); *A63B 71/023* (2013.01); *A63B 2210/50* (2013.01)

(58) Field of Classification Search

CPC ..... A63B 1/00; A63B 17/00; A63B 21/0722; A63B 21/0724; A63B 21/4037; A63B 21/00047; A63B 21/00178; A63B 21/4027; A63B 21/4029; A63B 71/023; A63B 71/0036; A63B 2071/025; A63B 2071/026; A63B 2210/50; A63B 2225/09; A63B 2209/10

See application file for complete search history.

(56) References Cited

U.S. PATENT DOCUMENTS

| | | | | |
|---|---|---|---|---|
| 860,517 | A * | 7/1907 | Berglund | |
| 5,637,059 | A * | 6/1997 | Dalebout | A63B 21/4029 482/52 |
| 7,275,273 | B2 | 10/2007 | Lary et al. | |
| 7,608,029 | B2 * | 10/2009 | Weiss | A63B 1/00 482/142 |

* cited by examiner

*Primary Examiner* — Megan Anderson

(74) *Attorney, Agent, or Firm* — Charter IP LLC

(57) ABSTRACT

A portable, foldable barre exercise device providing balance support for a user during exercise may include a pair of legs and a pair of support arms. Each support arm may be pivotally attached to a corresponding leg and may be adapted to be extended upward with the device in an open state. A horizontal exercise bar may be arranged between upper ends of the support arms. The device may further include a pair of weight stacks of removable dumbbells, each attached to a corresponding support arm, and one or more quick release straps for facilitating folding of the device into a closed state for stowage and for strapping the support arms and legs together. The device is lightweight yet structurally configured so as to support a user's entire weight thereon.

14 Claims, 6 Drawing Sheets

PORTABLE BARRE EXERCISE DEVICE

CROSS-REFERENCE TO RELATED APPLICATION

The present application claims the benefit under 35 U.S.C. § 119(e) of U.S. Provisional Patent Application Ser. No. 62/744,939 to the inventor, filed Oct. 12, 2018. The entire contents of this provisional application is hereby incorporated by reference herein.

BACKGROUND

Field

The example embodiment in general is directed to a portable barre exercise device.

Related Art

Barre is a fusion of Pilates, yoga, ballet and strength and has become one of the hottest trends in fitness. In general a barre workout requires use of a ballet bar exercise device, known as a barre ballet or simply a barre. Most barre-based exercises use a combination of postures inspired by one or more of ballet, yoga and Pilates. The barre serves as a prop to balance the user while performing exercises that focus on isometric strength training (for example, holding one's body still while contracting a specific set of muscles), often combined with high reps of small range-of-motion movements.

FIGS. 1 and 2 illustrate a prior art ballet bar exercise device ("barre"). The device 10 comprises a pair of telescoping legs 12, telescoping support arms 14 pivotally attached to the legs 12 at the legs' distal ends 15, a height adjustable horizontal exercise bar 16 mounted between the support arms 14, a first lower cross bar 18 connecting the legs 12 intermediate their ends, a second lower cross bar 19 connecting the legs 12 at their distal ends 15, and an upper cross bar 20 connecting the support arms 14. A backboard 22 is pivotally attached to the upper cross bar 20 and is releasably attached to the first lower cross bar 18. A floor board 24 is hingedly attached to the backboard 22; each may covered by soft mats 25 as shown in FIG. 2.

To set up device 10, a user starts with the device 10 lying on the floor with the rear surface of the backboard 22 facing up. Leg straps 40 are and the exercise bar 16 is lifted to unfold device 10. Next, the backboard 22 is locked into a vertical position by attaching it to the lower cross bar 18 via hinges (not shown) and by ensuring that a spring loaded handle 38 locks in place over the hinge. The floor board 24 is unfurled to lay flat on the floor, and then the telescoping legs 12 can be fully extended. The exercise bar 16 can be adjusted to a desired height by retracting spring loaded knobs 36 mounted at each end of the upper cross bar 20.

To fold device 10, the legs 12 are first collapsed telescopically. Next, the floor board 22 and backboard 24 are unsnapped from the lower cross bar 18 after retracting the spring loaded handle 38. With the boards 22, 24 disconnected from the first lower cross bar 18, the boards 22, 24 can be swung rearward by pivoting the boards 22, 24 around the upper cross bar 20 until the backboard 22 is approximately are aligned with the support arms 14. Next, the user grabs the exercise bar 16 and lowers the support arms 14 until they are aligned with the legs 12 on the floor surface.

Portable barre devices such as shown in FIGS. 1 and 2 suffer certain limitations. Folding conventional portable barres often entail a number of different procedural steps to ready it for storage and/or transport. Additionally, it is not possible to perform pulling-type exercises with conventional portable barre devices. This is primarily due to the fact that these conventional barre devices are light weight. Thus, these barre devices typically tip or topple over when attempting a pulling exercise using the exercise bar or with resistance bands attached to device 10. Moreover, pushing exercises against many of these conventional barre devices will also cause the device to topple, as no leverage moment is provided against a pushing force.

SUMMARY

An example embodiment of the present invention is directed to a portable barre exercise device. The device may include a pair of legs, each leg having a proximal end and a distal end disposed away from the proximal end, a pair of support arms, each support arm having a proximal end and a distal end disposed away from the proximal end, each support arm pivotally attached at its proximal end to a corresponding leg at the leg's proximal end, and a horizontal exercise bar arranged between the distal ends of the support arms. The device further may include a weight stack attached to each of the proximal ends of the support arms, each weight stack including a bracket adapted to support one or more hand weights therein.

Another example embodiment is directed to a portable, foldable barre exercise device having a pair of legs in spaced relation to one another and oriented to be in contact along a length thereof with a floor surface with the device in an open state, and a pair of support arms in space relation to one another and extending upward at a lower end thereof from the legs with the device in the open state. Each support arm may be pivotally attached at its lower end to a corresponding front end of a leg, and a horizontal exercise bar may be arranged between upper ends of the support arms. The device may further include a diagonal cross rod comprising a pair of diagonally crossed members intersecting intermediate of the cross rod between the support arms, and a pair of gusset rods. Each gusset rod may have one end connected intermediate to its corresponding support arm, and its other end extending rearward and downward along a diagonal plane so as to be connected to an intermediate point on a corresponding leg.

Another example embodiment is directed to a portable, foldable barre exercise device. The device may include a horizontal barre exercise bar elevated above a floor surface by supporting structure in contact with the floor surface, and a pair of weight stacks of removable dumbbells, each weight stack attached to the supporting structure.

BRIEF DESCRIPTION OF THE DRAWINGS

Example embodiments will become more fully understood from the detailed description given herein below and the accompanying drawings, with like elements represented by like reference numerals, which are given by way of illustration only and thus are not limitative of the example embodiments herein.

DETAILED DESCRIPTION

Figure 1:
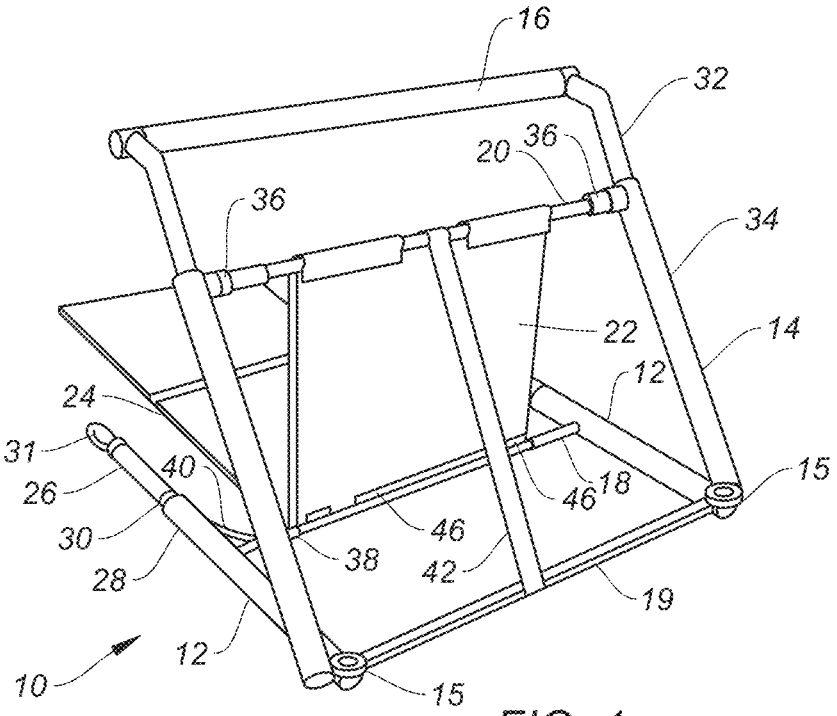
FIG. 1 (Prior Art)
FIG. 1 shows a folded version of a conventional ballet bar exercise device.
Figure 2:
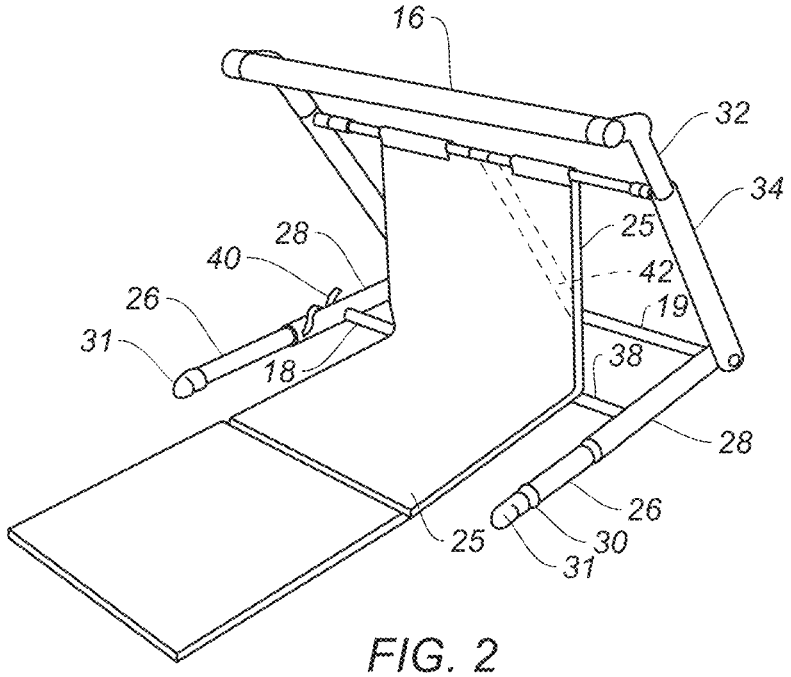
FIG. 2 (Prior Art)
FIG. 2 shows the device of FIG. 1 in an open state for exercise use.
Figure 3:
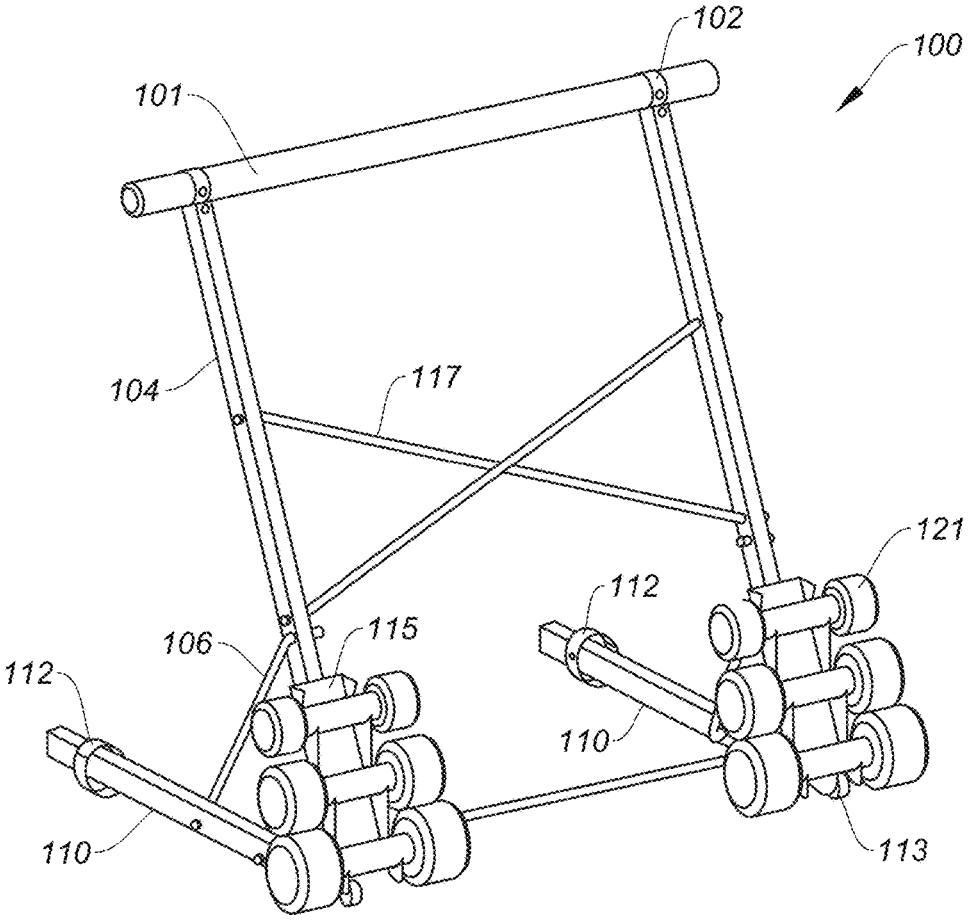
FIG. 3 is a front perspective view of a barre device according to the example embodiment.
Figure 4:
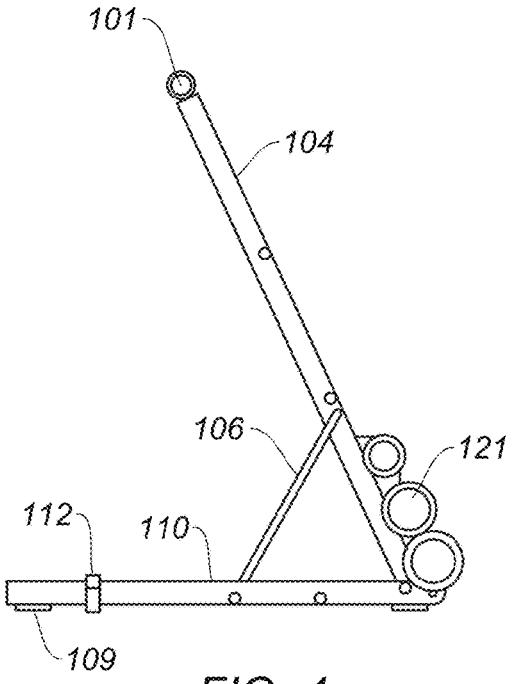
FIG. 4 is a left-side elevational view of the device of FIG. 3, the right-side view being a mirror image thereof.
Figure 5:
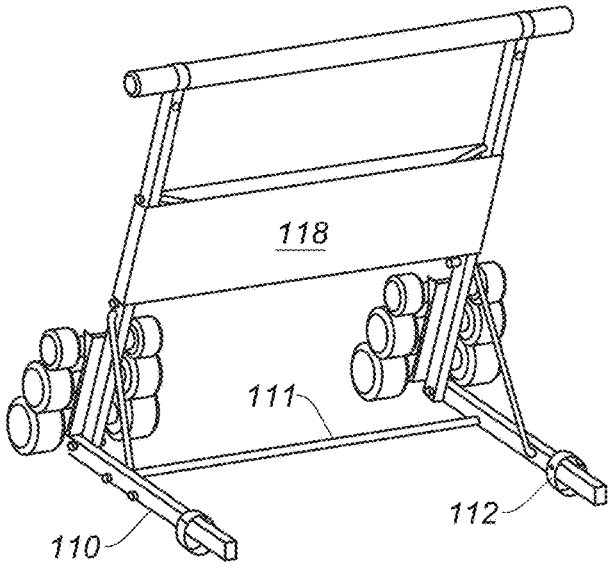
FIG. 5 is a rear perspective view of the device of FIG. 3.
Figure 6:
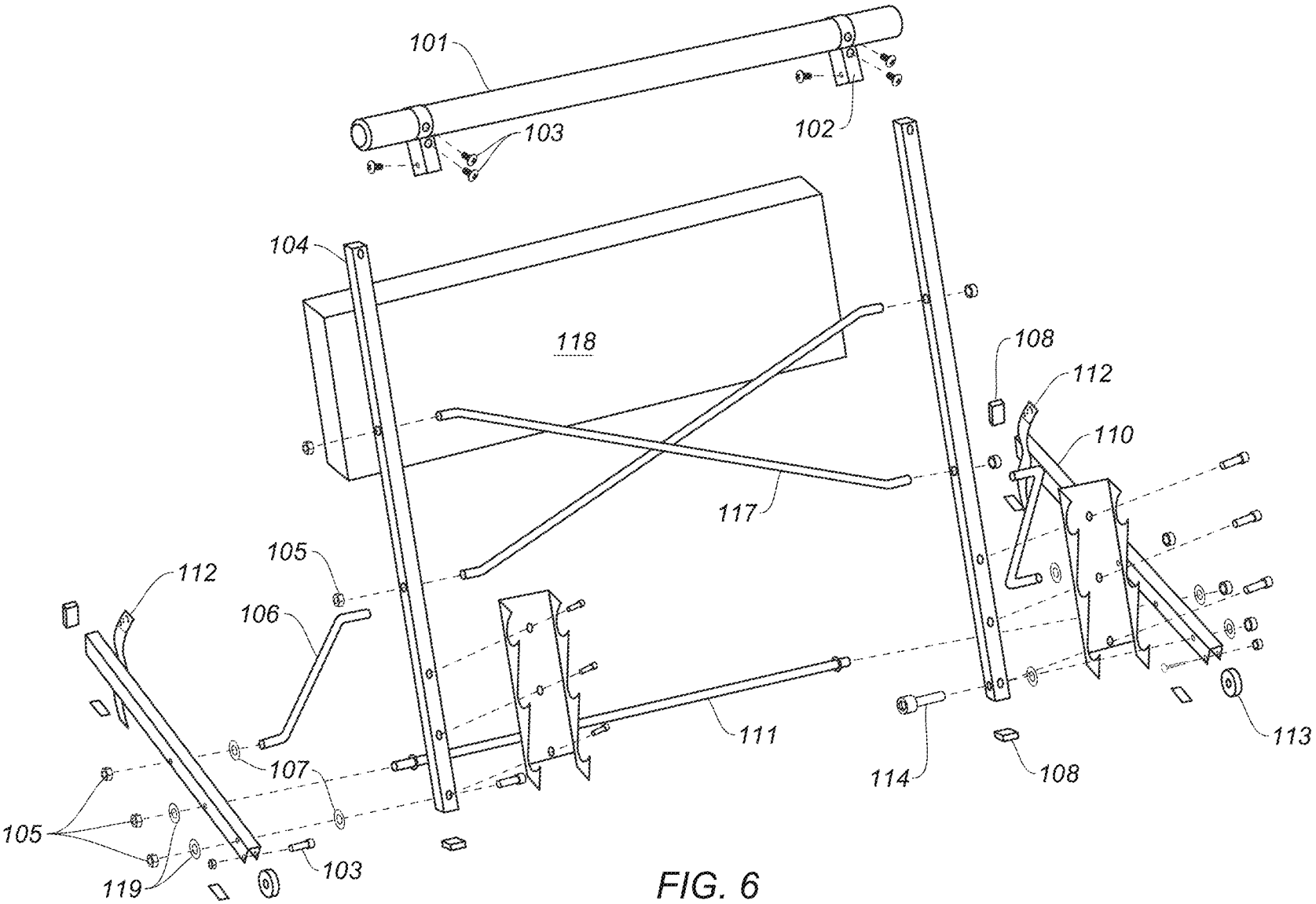
FIG. 6 is an exploded parts view of the device of FIG. 3.

In the following description, certain specific details are set forth in order to provide a thorough understanding of one or more example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment. Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size. In the drawings, identical reference numbers identify similar elements or acts. The size and relative positions of elements in the drawings are not necessarily drawn to scale.

The example embodiment hereafter describes a portable, lightweight barre device (hereafter "device 100") adapted for use by a user for balance during exercise, enabling the user to be able to perform both pushing exercises or movement against device 100, or pulling exercises from device 100 without toppling device 100. Namely, the construction and structure of lightweight device 100 provides a leveraging moment against the user, whether or not the user is pushing on or pulling away from device 100. The structure of lightweight device 100 also permits a user to put their entire weight thereon. Additionally, device 100 is equipped with a simple quick-release mechanism that straps the legs and arms together for storage.

Referring to FIGS. 1-6, device 100 may include a pair of fixed-length legs 110 in spaced relation to one another, with a proximal or front end of each leg 110 pivotally attached to a proximal or bottom end of one of a corresponding pair of support arms 104. In an example, the support arms 104 may be slightly angled toward the user (as shown in the figures) to better position a horizontal barre exercise bar 101 ("exercise bar 101") over the legs 110. The support arms 104 may be fixed-length, or alternatively may be arranged in a telescoping dual-arm segment configuration with a smaller-diameter elongate upper member slideable within a larger-diameter elongate lower member, as is known in the art. This offers the ability to vary the height of the exercise bar 101 that is attached to distal or upper ends of the support arms 104 via retainers 102 that may be secured by suitable fasteners 103 (in this example hex screws).

To adjust the height of the exercise bar 101, and in an example dual-arm segment configuration of the support arm 104 with the upper member slideable within the lower member, each lower member may include a spring loaded detent that is pushed into the inner area of the lower member, which allows the upper member of support arm 104 to slide freely within the lower member as it is retracted. The exercise bar 101 can then be adjusted to the desired height via a plurality of vertically spaced holes formed in the upper member of the support arm 104. When the exercise bar 101 is at the desired height, the spring loaded detents of the lower members release to engage the corresponding holes in the upper members of the pair of support arms 104.

With device 100 setup in an open, unfolded state, the support arms 104 extend generally upward from the legs 110, which extend rearward along their length to contact a planar surface such as a floor, as shown. Each end of a base rod 111 extends through a corresponding lower end of the support arms 104 and is secured to legs 110 via suitable fasteners, such as washers 107 and cap nuts 105. The proximal or bottom ends of the support arms 104 and the distal or rear ends of legs 110 are closed by end caps 108. Rubber feet 109 may be attached along and on an underside of each leg 110. To permit movement of the device 100 along a floor, a pair of wheels 113 may be connected thereto, with one wheel 113 attached to each inside proximal end of its corresponding leg 110 via suitable fastener means such as an inner hex screw 103 and a cap nut 105. The proximal or bottom end of each support arm 104 is attached to the proximal or front end of each leg 110 via a suitable fastener means such as carriage bolt 114, washer 107, spring cushion 119, and a cap nut 105. This construction of attachment of the support arms 104 to the legs 110 serves as a pivot point to permit articulating movement between the legs 110 and support arms 104, thereby facilitating folding and unfolding device 100.

A diagonal cross rod 117 may be secured midway up between the support arms 104 via fasteners such as cap nuts 105. On each side, a gusset rod 106 may be connected to its corresponding support arm 104 at a first or proximal end above the base rod 111, but below the lower portion of the diagonal cross rod 117. A second or distal end of each gusset rod 106 may extend rearward and downward along a diagonal plane so as to be connected to a midway point on a corresponding leg 110, via suitable fastener means such as washer 107 and cap nut 105. The combination of employing the diagonal cross rod 117 and the gusset rods 106 in device 100 lend significant stability and strength to device 100, so as to permit a user to place their entire weight onto the device 100. Ion an example loading test, device 100 has tested at 625 pounds of loading.

Device 100 may include an optional weight stack comprised of a pair of brackets 115 for holding a stack 121 of hand weights, such as dumbbells. With the device 100 supporting stacks 121 of hand weights as is shown, a user is permitted to do pulling exercises using the device 100 as leverage. This is because the additional weight stack 121 is positioned to maximize the leveraging impact of the weights therein for stabilizing device 100, such that it does not tip over. Further, the total weight of the weight stacks 121 can be varied to lend sufficient weight to device 100, so as to stabilize it at its base, and additionally so that the user may also perform pushing or pulling exercises against device 100 without toppling it.

Figure 9:
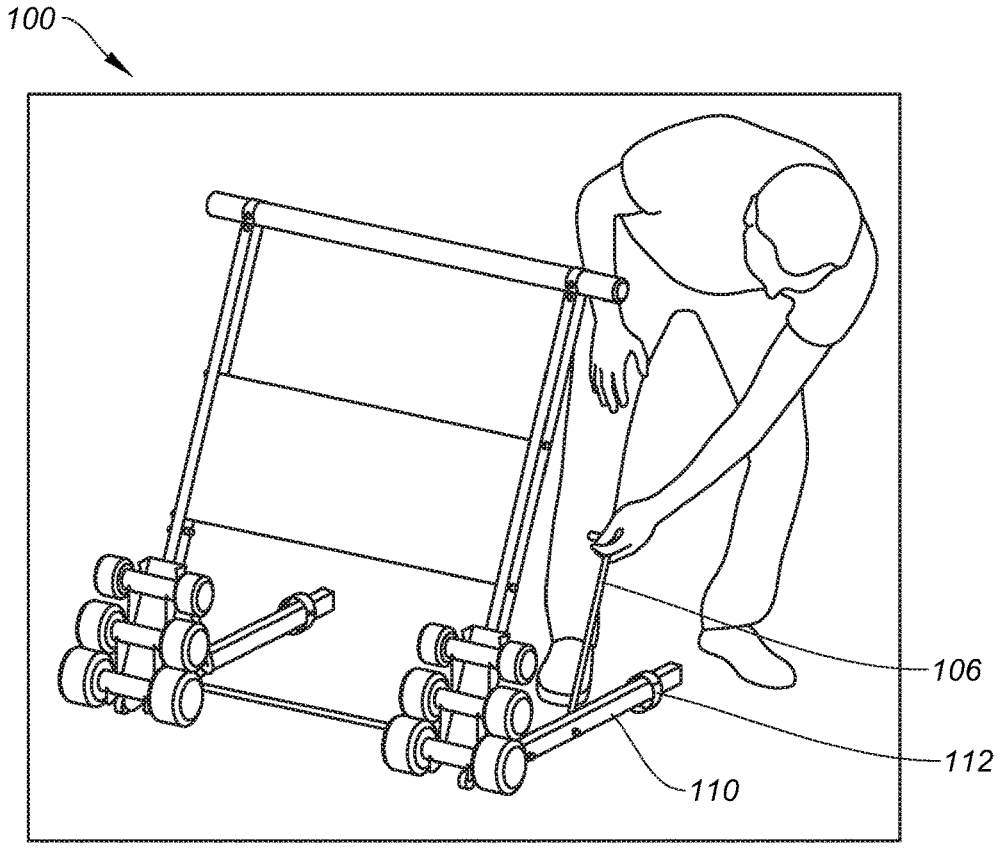
FIGS. 9 through 13 are illustrations for describing a folding sequence for stowage of the portable, lightweight barre device, and a setup sequence for use of the device in exercise.
Figure 10:
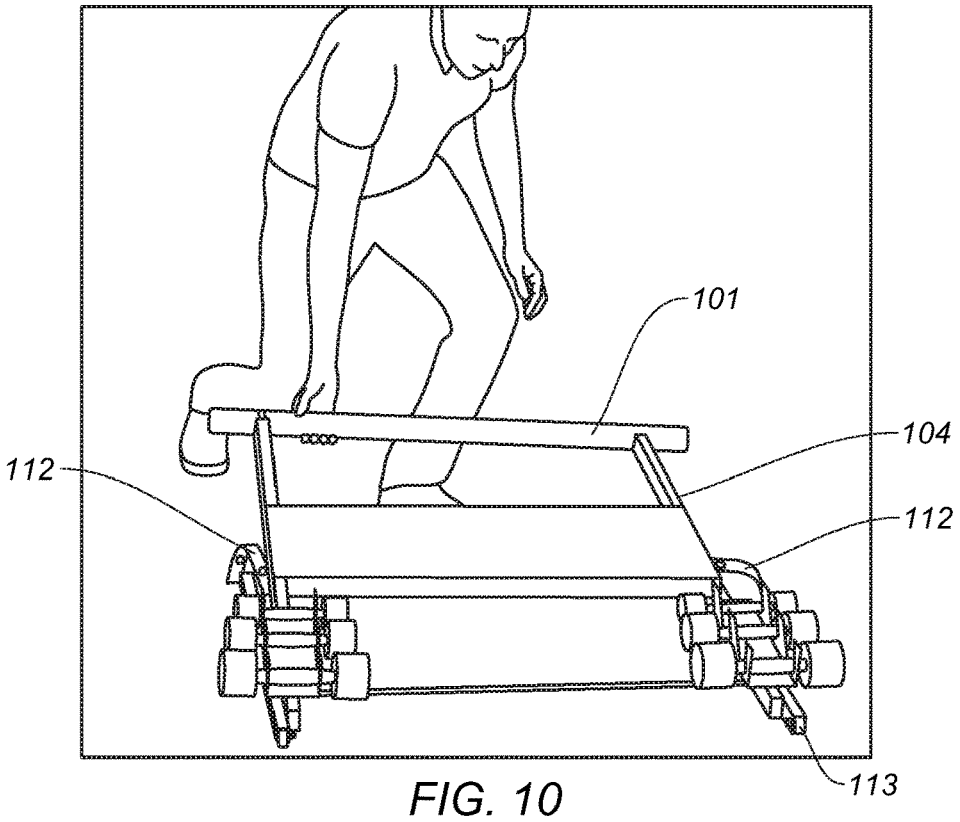

Device 100 may fold down flat for stowage. The folding feature may be facilitated by way of a pair of quick release Velcro over straps 112 that also serve the purpose of strapping the support arms 104 and legs 110 together for stowage. Namely, FIGS. 9 through 13 are illustrations for describing a folding sequence to stow the portable, lightweight barre device 100, and for describing a setup sequence to use device 100 for exercise. Initially, and as shown in FIG. 9, a user may loosen the Velcro over straps 112 around legs 110 and unhinge each gusset rod 106 from its corresponding support arm 104 at its proximal end above the base rod 111, pivoting each gusset rod 106 downward and rearward so that the gusset rod 106 may lay next to its corresponding leg 110 on the floor 120. This permits the user (by grasping exercise bar 101) to fold or lower the arms 104 with exercise bar 101 down and backward to the floor 120, enabling each support arm 104 to rest adjacent its corresponding leg 110, as shown best in FIGS. 10 and 12.

Figure 13:
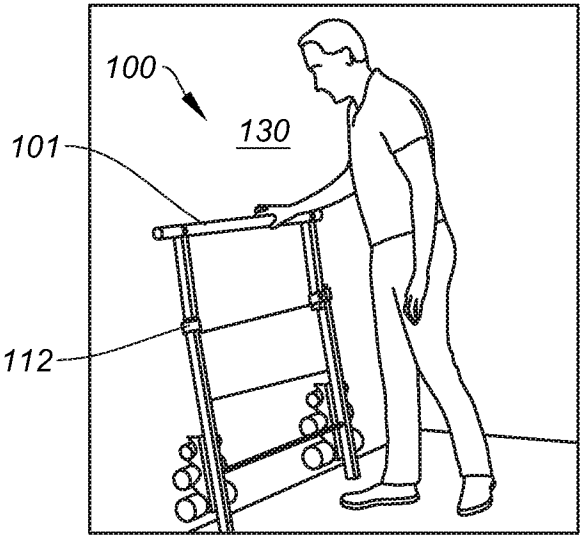
Figure 11:
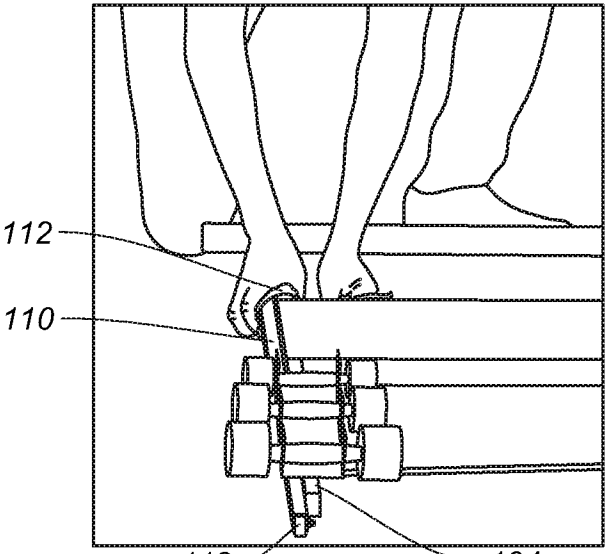
Figure 12:
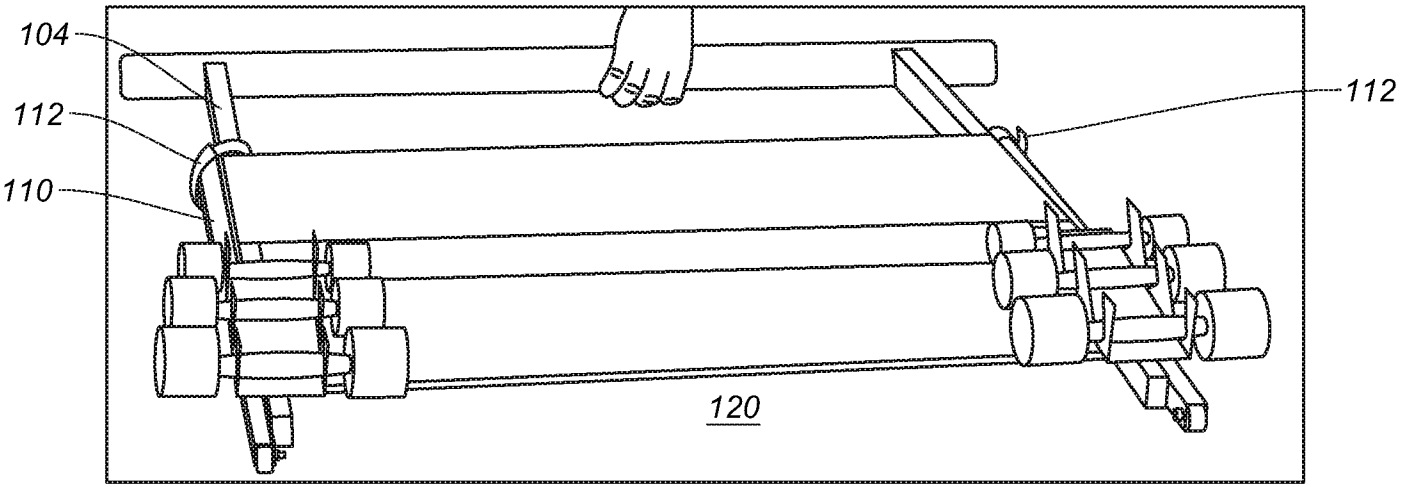

Next, the user may utilize the Velcro over straps 112 to secure each support arm 104, gusset rod 106, and leg 110 together, flatting device 100 on floor 120 (FIG. 11). FIG. 12 shows the device 100 prone on floor 120 in a configuration that is stowage-ready. At this point, the user may simply grab the exercise bar 101, and via the wheels 113 roll the device 100 to a final storage location or resting place, such as against a wall 130 as shown in FIG. 13, or under a bed, in a trunk of a vehicle, etc.

For setup, a user performs a simple reversal of the previous steps for stowage, namely: (a) unwind Velcro over straps 112 and remove, (b) lift exercise bar 101 as support arms 104 connected thereto pivot upward, (c) with exercise bar 101 raised and being held up, next connecting the gusset rods 106 to the support arms 104, and (d) wrapping each Velcro over strap 112 to its corresponding support arm 104 to finish the setup procedure.

Despite its ability to support a substantial loading, the device 100 remains lightweight and portable (weight=approx. 20 pounds or less without the weight stack 121). An optional stretch sleeve 118 may be provided for aesthetic purposes to cover the diagonal cross rod 117, as well as to provide a printable space for a product or company logo, which may be customized as desired by a user or exercise facility.

Figure 8:
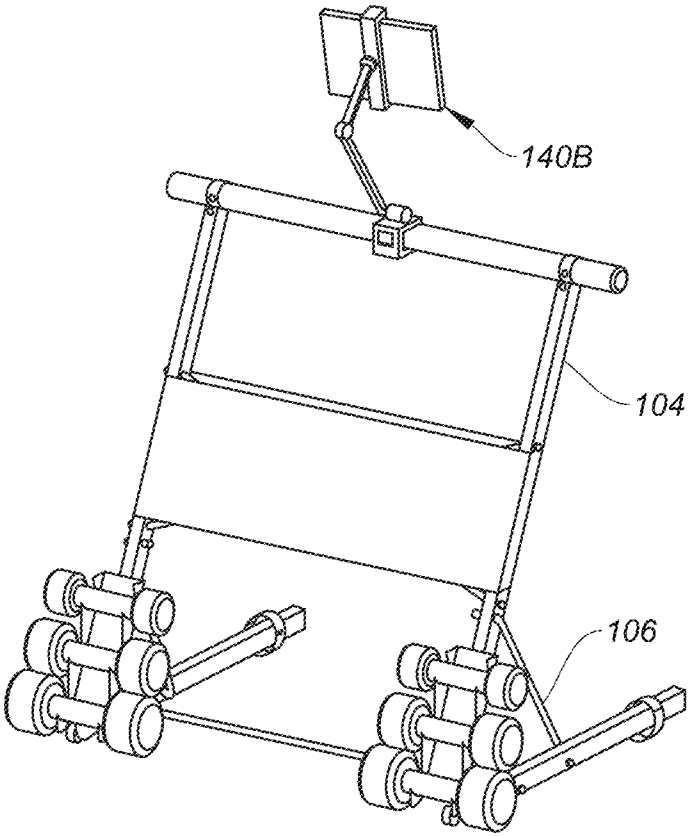
FIG. 8 is a front perspective view to illustrate the smart device attachment means of FIG. 7 holding a tablet.
Figure 7:
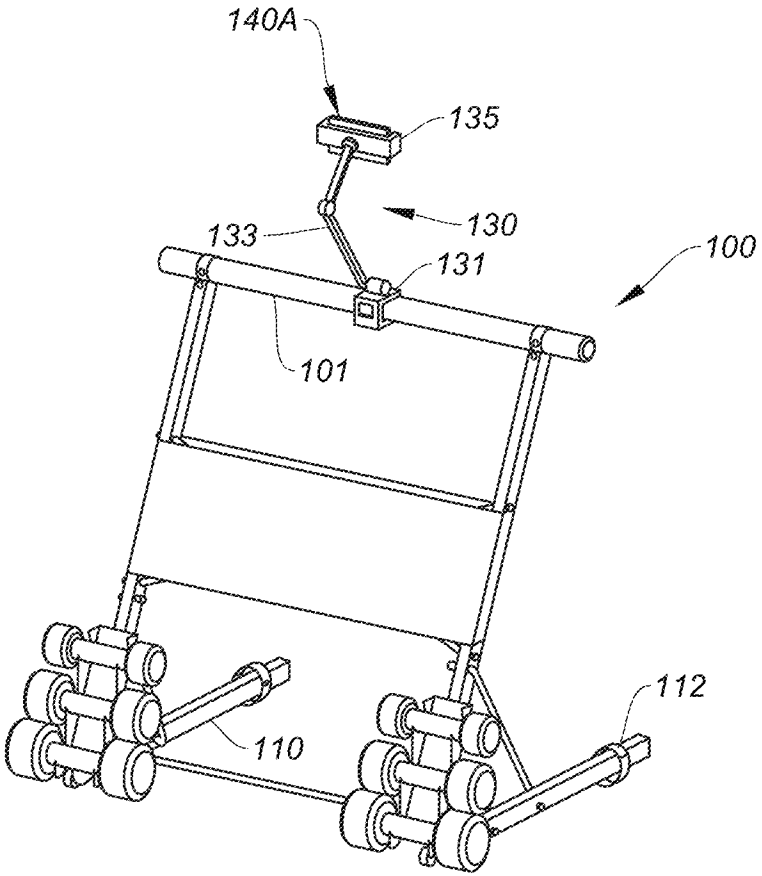
FIG. 7 is a front perspective view to illustrate a smart device attachment means holding a smartphone.

Referring to FIGS. 7 and 8, device 100 may include an optional smart device attachment means 130. Attachment means 130 in an example may include a base bracket 131 attached to exercise bar 101, and an articulating extension member 133 extending from the base bracket 131 and terminating at a holder bracket 135. The holder bracket 135 may be stretchable or telescoping to secure various-sized smart computing devices therein, so that the user may view exercise videos or other video content during their workout. As shown, example smart devices may include but are not limited to smart phones 140A and tablets 140B, for example.

The portable barre exercise device 100 described herein is usable for a variety of fitness and dance exercises, including but not limited to barre fitness, calisthenics, ballet, strength exercises, and Pilates exercises. Exercises may be done standing next to the device 100, seated by it, kneeling by device 100, or laying on the floor by the device 100. The user can engage their hands (one or both) on the device 100, or their elbows, or their arms or legs (such as leg stretching exercises), or may attach other exercise apparatuses (such as a resistance band). Due to the weighted stack 121, the user is able to push on or pull from device 100, as the device 100 as loaded with the weight stacks 121 provide a leveraging moment to prevent the device 100 from toppling over.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and\ or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

I claim:

1. A portable barre exercise device, comprising:

a pair of legs, each of the pair of legs having a proximal end and a distal end disposed away from the proximal end, a pair of support arms, each of the pair of support arms having a proximal end and a distal end disposed away from the proximal end, each of the pair of support arms pivotally attached at its proximal end to a corresponding leg of the pair of legs at a proximal end of the corresponding leg, a horizontal exercise bar mounted between the distal ends of the pair of support arms, and a weight stack attached to each of the proximal ends of the pair of support arms, each of the weight stacks including a bracket adapted to support one or more hand weights therein.

2. The portable barre exercise device of claim 1, further comprising:

a diagonal cross rod secured intermediate between the pair of support arms, and a pair of gusset rods, each of the pair of gusset rods having a proximal end connected intermediate to a corresponding support arm of the pair of arms, and a distal end extending rearward and downward along a diagonal plane so as to be connected to an intermediate point on a corresponding leg of the pair of legs.

3. The portable barre exercise device of claim 2, wherein the proximal end of each of the pair of gusset rods is connected to a corresponding support arm of the pair of arms below a lower portion of the diagonal cross rod.

4. The portable barre exercise device of claim 2, wherein the diagonal cross rod and pair of gusset rods lend stability and strength to the portable barre exercise device so as to permit a user to place their entire weight onto the portable barre exercise device.

5. The portable barre exercise device of claim 1, wherein with the portable barre exercise device loaded up with the weight stacks, a user in contact with the portable barre exercise device is capable of performing pulling exercises with the portable barre exercise device using the portable barre exercise device as leverage, so that the portable barre exercise device does not topple.

6. The portable barre exercise device of claim 1, wherein with the portable barre exercise device loaded up with the weight stacks, a user is capable of performing pushing exercises against the portable barre exercise device using the portable barre exercise device as leverage, so that the portable barre exercise device does not topple.

7. The portable barre exercise device of claim 1, further comprising a horizontal base rod arranged between the pair of support arms at a proximal end thereof, each respective end of the horizontal base rod extending between and through a corresponding support arm of the pair of arms and fixedly secured to its corresponding leg of the pair of legs.

8. The portable barre exercise device of claim 1, further comprising one or more quick release straps facilitating folding of the portable barre exercise device into a closed state for stowage, the one or more quick release straps further configured for strapping the pair of support arms and pair of legs together.

9. The portable barre exercise device of claim 1, wherein each of the pair of legs has a fixed length, and each of the pair of support arm is configured to have a fixed length or an expandable or varied length.

10. The portable barre exercise device of claim 1, further comprising removable attachment means connected to the horizontal exercise bar for securing a smartphone or tablet therein.

11. A portable, foldable barre exercise device, comprising:

a pair of legs in spaced relation to one another and oriented to be in contact along a length thereof with a floor surface with the portable barre exercise device in an open state, a pair of support arms in space relation to one another and extending upward at a lower end thereof from the pair of legs with the portable barre exercise device in the open state, each of the pair of support arm pivotally attached at its lower end to a corresponding front end of a leg of the pair of legs, a horizontal exercise bar mounted between upper ends of the pair of support arms, a diagonal cross rod comprising a pair of diagonally crossed members intersecting intermediate of the diagonal cross rod between the pair of support arms, and a pair of gusset rods, each of the pair of gusset rods having one end connected intermediate to a corresponding support arm of the pair of support arms, and its other end extending rearward and downward along a diagonal plane so as to be connected to an intermediate point on a corresponding leg of the pair of legs;

one or more quick release straps facilitating folding of the portable barre exercise device into a closed state for stowage, the one or more quick release straps further configured for strapping the pair of support arms and pair of legs together; and a weight stack attached to each of the lower ends of the pair of support arms, each of the weight stacks including a bracket adapted to support one or more hand weights therein.

12. The portable barre exercise device of claim 11, wherein the diagonal cross rod and pair of gusset rods lend stability and strength to the portable barre exercise device so as to permit a user to place their entire weight onto the portable barre exercise device.

13. The portable barre exercise device of claim 11, wherein with the portable barre exercise device loaded up with the weight stacks, a user in contact with the portable barre exercise device is capable of performing pulling exercises using the portable barre exercise device as leverage, so that the portable barre exercise device does not topple.

14. The portable barre exercise device of claim 1, wherein with the portable barre exercise device loaded up with the weight stacks, a user is capable of performing pushing exercises against the portable barre exercise device using the portable barre exercise device as leverage, so that the portable barre exercise device does not topple.

* * * * *